US005371443A

United States Patent [19]

Sun et al.

[11] Patent Number: 5,371,443

[45] Date of Patent: Dec. 6, 1994

[54] ELECTRONIC BALLAST OF THE HIGH POWER FACTOR-CONSTANT POWER TYPE

[75] Inventors: Seo H. Sun; Seong K. Young; Han M. Su, all of Seoul, Rep. of Korea

[73] Assignee: Hyun In Information Corporation, Seoul, Rep. of Korea

[21] Appl. No.: 106,713

[22] Filed: Aug. 16, 1993

[30] Foreign Application Priority Data

Mar. 25, 1993 [KR] Rep. of Korea ..... 1993-4645

[51] Int. Cl.[5] ..... H05B 41/16

[52] U.S. Cl. ..... 315/247; 315/309; 315/307; 315/308; 315/291; 315/DIG. 5

[58] Field of Search ..... 315/247, 307, 308, 291, 315/205, 309, DIG. 5; 337/298, 14

[56] References Cited

U.S. PATENT DOCUMENTS

| | | | |
|---|---|---|---|
| 4,277,726 | 7/1981 | Burke | 315/205 |
| 4,316,125 | 2/1982 | Noguchi | 315/247 |
| 4,963,797 | 10/1990 | Kulku et al. | 315/309 |

*Primary Examiner*—Robert J. Pascal
*Assistant Examiner*—Reginald A. Ratliff
*Attorney, Agent, or Firm*—Harrison & Egbert

[57] ABSTRACT

An electronic ballast of the high power factor-constant power type comprising a power factor correction and constant voltage circuit for inputting a supply voltage through a temperature switch, a noise removing filter and a full-wave rectifying circuit, the power factor correction and constant voltage circuit storing electric energy during a conductive period of a load and, using a counter electromotive force resulting from the electric energy during a non-conductive period of the load, enhancing a power factor at an input stage and generating a constant voltage regardless of a variation in the supply voltage, a constant current inverter circuit connected to the power factor correction and constant voltage circuit to convert the constant voltage into a sinusoidal wave voltage, so as to supply a constant current for maintaining a normal lighting state of a discharge lamp, and a high voltage generating circuit connected to the power factor correction and constant voltage circuit to supply a high voltage pulse for initial discharging between electrodes of the discharge lamp. According to the invention, the instantaneous starting and lighting of the discharge lamp can readily been performed regardless of a variation in the input voltage and the consumption power can be reduced by the high power factor and efficiency.

4 Claims, 5 Drawing Sheets

ELECTRONIC BALLAST OF THE HIGH POWER FACTOR-CONSTANT POWER TYPE

BACKGROUND OF THE INVENTION

1. Field of the Invention

The present invention relates in general to electronic ballasts of the high power factor-constant power type, and more particularly to an electronic ballast for starting, lighting and maintaining a variety of discharge lamps such as a neon lamp, a mercury lamp, a natrium lamp, a metal lamp and etc.

2. Description of the Prior Art

A ballast for a discharge lamp being widely used now, more particularly a ballast for a high voltage discharge lamp employs a magnetic circuit, namely, a transformer. In such a ballast of the magnetic circuit type, the transformer is provided with copper wires which have a predetermined thickness to cope with a high voltage being applied to a load and a large amount of current flowing therethrough, and a core which is large in size to have a reactance at a low frequency of 50/60 Hz. With this construction of the transformer, the ballast of the magnetic circuit type is disadvantageously very heavy in weight and large in size. This disadvantage becomes more prominent as the discharge lamp as the target to be driven requires a higher power. Also, the ballast of the magnetic circuit type has another disadvantage in that a supply power thereto is partially consumed due to an eddy current and a hysteresis loss of the core, resulting in generation of a large amount of heat in the ballast and, thus, waste of energy.

The ballast of the magnetic circuit type has widely been used until now in spite of the disadvantages that it has a large amount of power loss and is large in size and heavy in weight. However, a demand for power saving appliances has recently been increased according to a rapidly increased demand for power. More particularly, it has keenly been required to save energy in industrial and public high power electric appliances. With commercialization of an electronic circuit type-ballast for a fluorescent lamp based on such a trend, in the discharge lamp field, it has been intended to change the magnetic ballast circuit into the electronic ballast circuit for the purpose of removing the power consumption resulting from the features of the discharge lamps.

One example of conventional ballasts of the electronic circuit type is an electronic ballast for a high voltage discharge lamp, which is shown in Korean Patent No. 44,447, filed on Jan. 7, 1989 and issued on Sep. 19, 1991. However, in this electronic ballast, since an alternating current (AC) input voltage is full-wave rectified, smoothed and then applied directly to the circuit, a power factor at a power input stage is bad and an amount of power supplied to a load is varied according to a variation in the input voltage. For this reason, the electronic ballast requires an input current larger than that in the existing magnetic ballast. Also, the variation in the supply power to the load or the discharge lamp results in a reduction in the life of the discharge lamp.

Furthermore, the conventional electronic ballast has no protection means against a short circuit of a load stage or an abnormal high temperature condition, resulting in an electric damage in the circuits.

SUMMARY OF THE INVENTION

Therefore, the present invention has been made in view of the above problems, and it is an object of the present invention to provide an electronic ballast of the high power factor-constant power type which is capable of readily performing instantaneous starting and lighting of a discharge lamp regardless of a variation in an input voltage and reducing consumption power with a high power factor and efficiency.

In accordance with the present invention, the above and other objects can be accomplished by a provision of an electronic ballast of the high power factor-constant power type, comprising: power factor correction and constant voltage means for inputting a supply voltage through a temperature switch, a noise removing filter and a full-wave rectifying circuit, said power factor correction and constant voltage means storing electric energy during a conductive period of a load and, using a counter electromotive force resulting from the electric energy during a non-conductive period of the load, enhancing a power factor at an input stage and generating a constant voltage regardless of a variation in the supply voltage, said temperature switch being opened under an abnormal high temperature condition to protect circuits from overheat, said noise removing filter including a condenser and a transformer, said full-wave rectifying circuit including a plurality of diodes; constant current inverter means connected to said power factor correction and constant voltage means to convert the constant voltage from said power factor correction and constant voltage means into a sinusoidal wave voltage, so as to supply a constant current for maintaining a normal lighting state of a discharge lamp; and high voltage generating means connected to said power factor correction and constant voltage means to supply a high voltage pulse for initial discharging between electrodes of the discharge lamp.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENT

Figure 1:
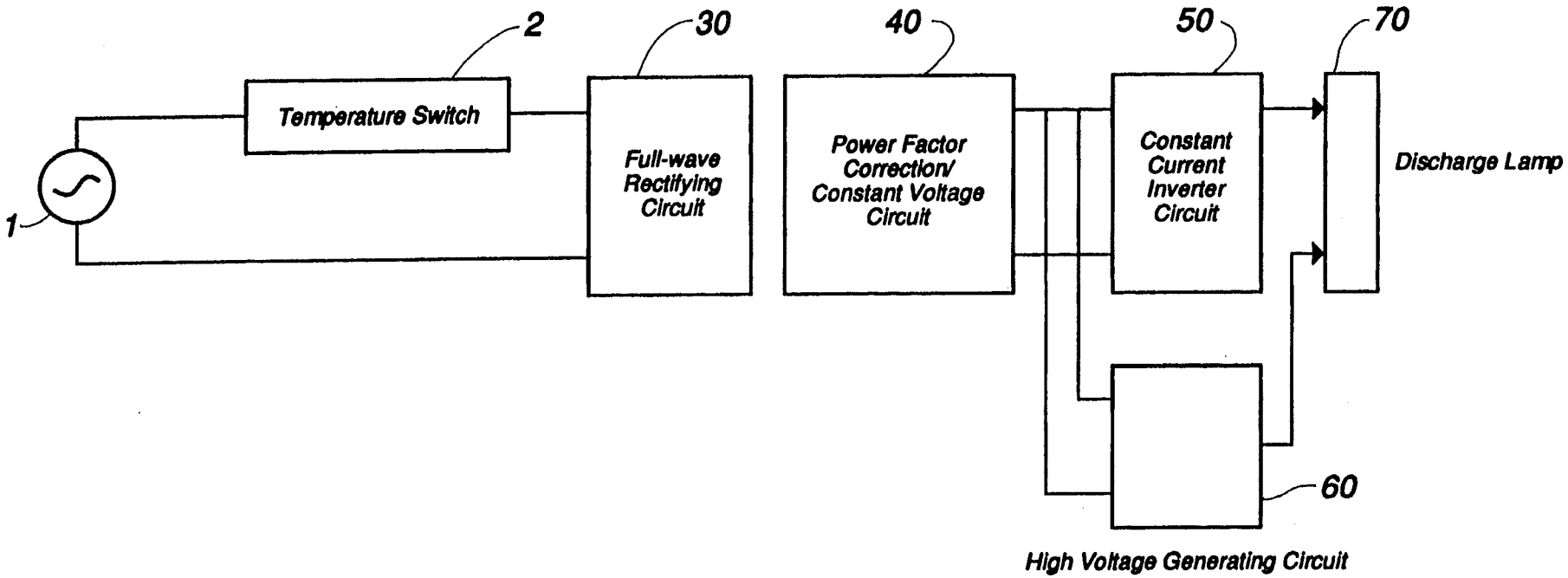
FIG. 1 is a block diagram of an electronic ballast of the high power factor-constant power type in accordance with the present invention.

Referring to FIG. 1, there is shown a block diagram of an electronic ballast of the high power factor-constant power type in accordance with the present invention. As shown in this drawing, the electronic ballast of the present invention comprises a power factor correction and constant voltage circuit 40 for inputting a supply voltage 1 through a circuit protecting temperature switch 2 and a full-wave rectifying circuit 30. The full-wave rectifying circuit 30 full-wave rectifies the supply voltage 1 and then applies the full-wave rectified voltage to the power factor correction and constant voltage circuit 40. The power factor correction and constant voltage circuit 40 is adapted to switch an input current in the opposite direction to a load during a conductive period of the load so as to enhance a power factor at an input stage, and supply a constant voltage to the load regardless of a variation in the input voltage. A constant current inverter circuit 50 is connected to the power factor correction and constant voltage circuit 40 to convert the constant voltage from the circuit 40 into a sinusoidal wave voltage, so as to supply a constant current for maintaining a normal lighting state of a discharge lamp 70. A high voltage generating circuit 60 is also connected to the power factor correction and constant voltage circuit 40 to supply a high voltage pulse for initial discharging between electrodes of the discharge lamp 70. At this time, a load voltage is maintained constant regardless of a variation in the supply voltage since the constant voltage is applied to the inverter circuit 50 and the constant current is supplied from the inverter circuit 50 to drive the discharge lamp 70. As a result, the power factor becomes high at the input stage.

Figure 2A:
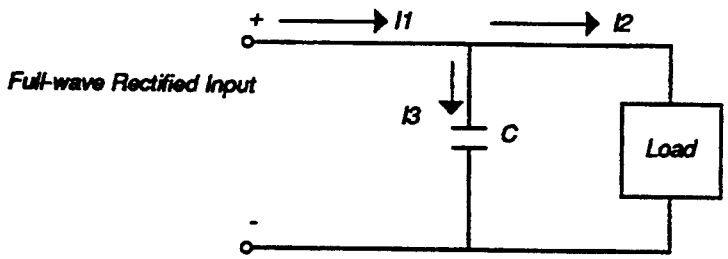
FIG. 2A is a schematic circuit diagram of a conventional electronic ballast.

FIG. 2A is a schematic circuit diagram of a conventional electronic ballast. In a conventional full-wave rectifying and smoothing circuit, a rectified current I1 flows by I2 to the load and by I3 to a smoothing condenser C, which recharges the current I3. In this case, since $I2<I3$ and $I1=I2+I3$, the power factor at the input stage becomes low.

Figure 2B:
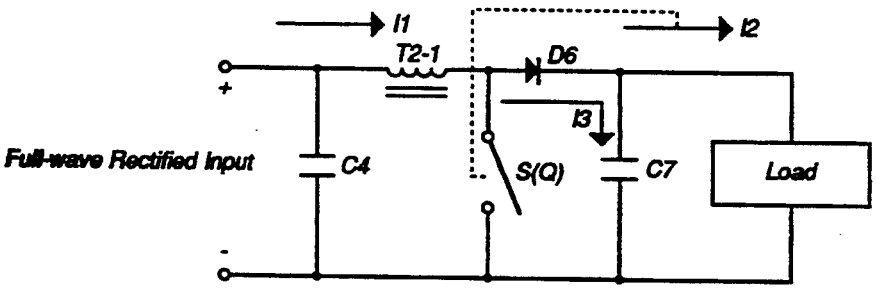
FIG. 2B is a schematic circuit diagram of the electronic ballast of the high power factor-constant power type accordance with the present invention.
Figure 2C:
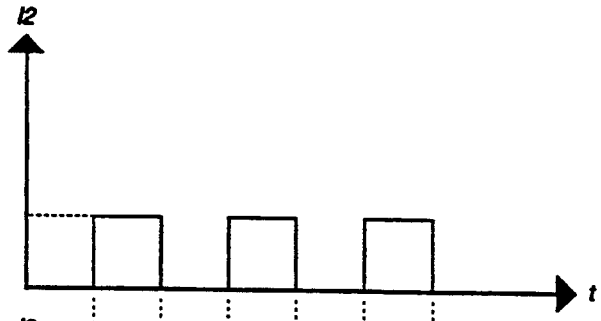
FIG. 2C is a waveform diagram of a current to a load in FIG. 2B.
Figure 2D:
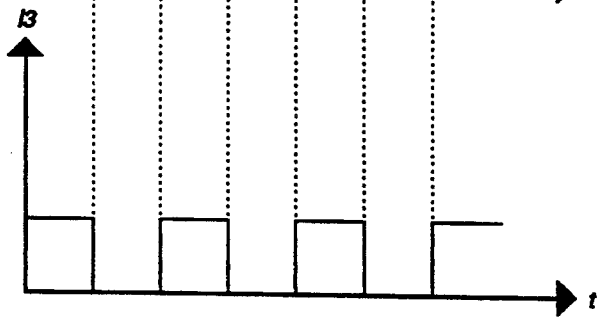
FIG. 2D is a waveform diagram of a current to a condenser in FIG. 2B.
Figure 2E:
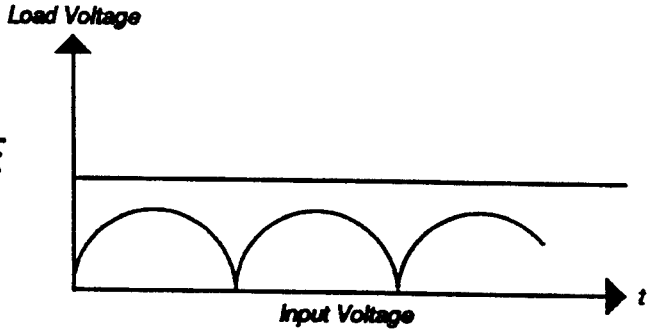
FIG. 2E is a waveform diagram of an input voltage and a load voltage in FIG. 2B.

FIG. 2B is a schematic circuit diagram of the electronic ballast of the high power factor-constant power type in accordance with the present invention. In this drawing, a condenser C4 is connected in parallel to the full-wave rectified input and has a small capacitance. A transformer T2-1 is connected in series to the current flow. A power switch S(Q) is provided to ground a current flowing through the transformer T2-1 to a minus (−) terminal or connect the current to a smoothing condenser C7 or the load through a diode D6. When the load is driven in a switching manner, the current I2 to the load is periodically conductive and non-conductive. When the switch S(Q) is turned on during the conductive period of the load, the transformer T2-1 and the condenser C4 constitutes a parallel resonance circuit with respect to the rectified input, so that electric energy is stored. On the other hand, when the switch S(Q) is turned off during the non-conductive period of the load, the condenser C4 and the transformer T2-1 constitutes a series resonance circuit with respect to the electric energy charged on the condenser C4, thereby causing a high counter electromotive force resulting from the electric energy to be applied as the current I3 to the smoothing condenser C7 through the diode D6. The current I3 is charged on the smoothing condenser C7. As a result, since the current I2 to the load and the current I3 to the smoothing condenser C7 are in the opposite phases as shown in FIGS. 2C and 2D and $I1=I2=I3$, the power factor at the input stage can be enhanced ideally. Also, because the counter electromotive force generated from the transformer T2-1 upon the turning-off of the switch S (Q) in FIG. 2B is higher than the rectified input voltage, the charging voltage on the smoothing condenser C7 is higher than a peak value of the input voltage as shown in FIG. 2E. Therefore, the diode D6 conducts only when the counter electromotive force is higher than the charging voltage on the smoothing condenser C7, so as to prevent the current I2 and the current I3 from flowing simultaneously. FIG. 2C is a waveform diagram of the current I2 to the load in FIG. 2B, FIG. 2D is a waveform diagram of the current I3 to the condenser C7 in FIG. 2B and FIG. 2E is a waveform diagram of the input voltage and the load voltage in FIG. 2B.

Figure 3A:
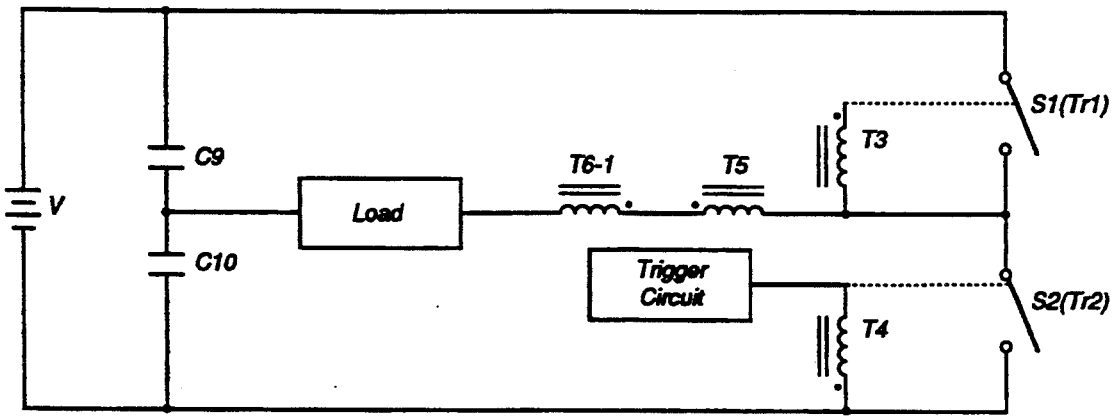
FIG. 3A is a schematic circuit diagram of a constant current inverter circuit in FIG. 1.
Figure 3B:
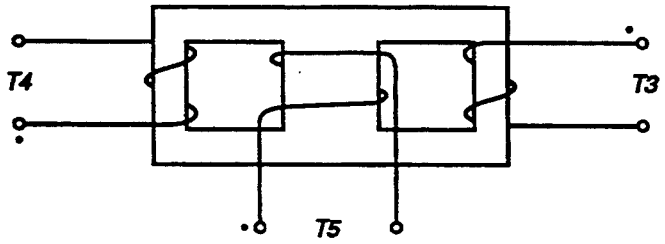
FIG. 3B is a view illustrating a construction of saturable transformers in FIG. 3A.
Figure 3C:
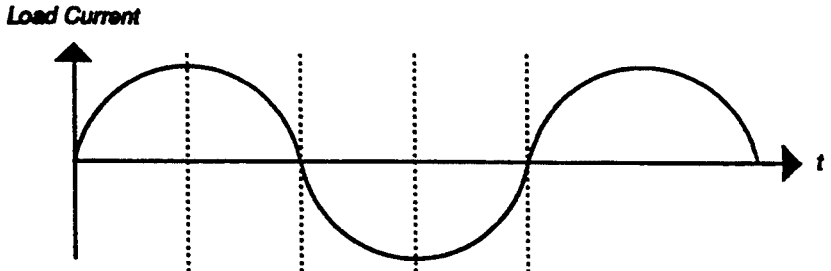
FIG. 3C is a waveform diagram of a load current in FIG. 3A.
Figure 3D:
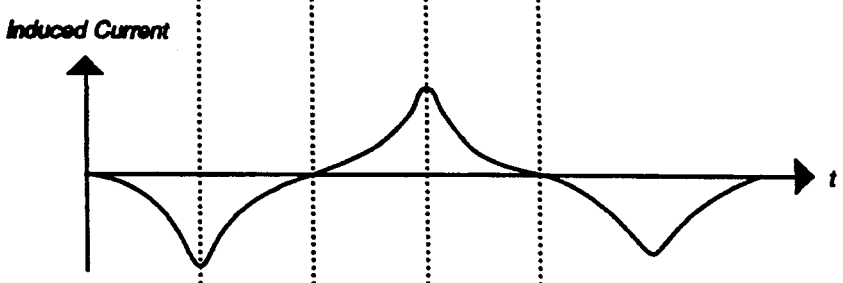
FIGS. 3D and 3E are waveform diagrams of currents from the saturable transformers in FIG. 3A.
Figure 3E:
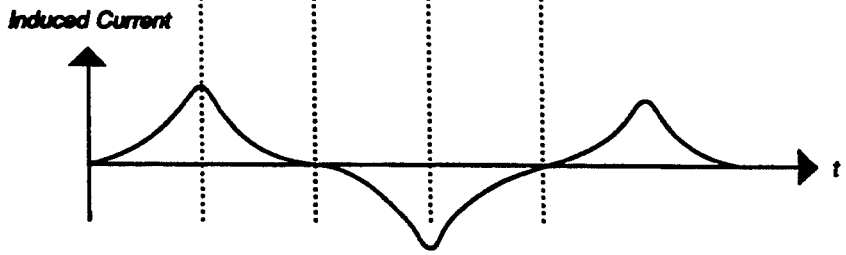

FIG. 3A is a schematic circuit diagram of the constant current inverter circuit 50 in FIG. 1. A supplied direct current (DC) voltage V is divided into V/2 by condensers C9 and C10 and then applied to one side of the load. Switches S1 (Tr1) and S2 (Tr2) are alternately turned on/off to generate ±V/2 voltages at a connection point of the condensers C9 and C10. When the switch S1 is turned on, a transformer T6-1 and the condenser C10 constitutes a series resonance circuit. Upon turning-on of the switch S2, the transformer T6-1 and the condenser C9 constitutes a series resonance circuit. The condensers C9 and C10 and the transformer T6-1 have such proper values as to constitute the series resonance circuits to supply a current approximate to a sinusoidal wave to the load. The switches S1 and S2 are driven by a saturable core which is comprised of transformers TS, T3 and T4 as shown in FIG. 3B. In the case where the switch S1 is turned on, the core is saturated when a current flowing through the transformer T5 is above a predetermined value, thereby causing a counter electromotive force to be generated from the core. In this case, a current induced in the transformer T3 upon turning-off of the switch S1 and a current induced in the transformer T4 upon turning-on of the switch S2 are in the opposite polarities. FIG. 3C is a waveform diagram of the current to the load in FIG. 3A, FIG. 3D is a waveform diagram of the current induced in the transformer T3 in FIG. 3A and FIG. 3E is a waveform diagram of the current induced in the transformer T4 in FIG. 3A.

In accordance with the present invention, in order to perform a succession of operations, the constant current inverter circuit 50 needs a trigger circuit which drives initially the switch S2 in FIG. 3A upon application of power, as will be described later in detail.

Figure 4:
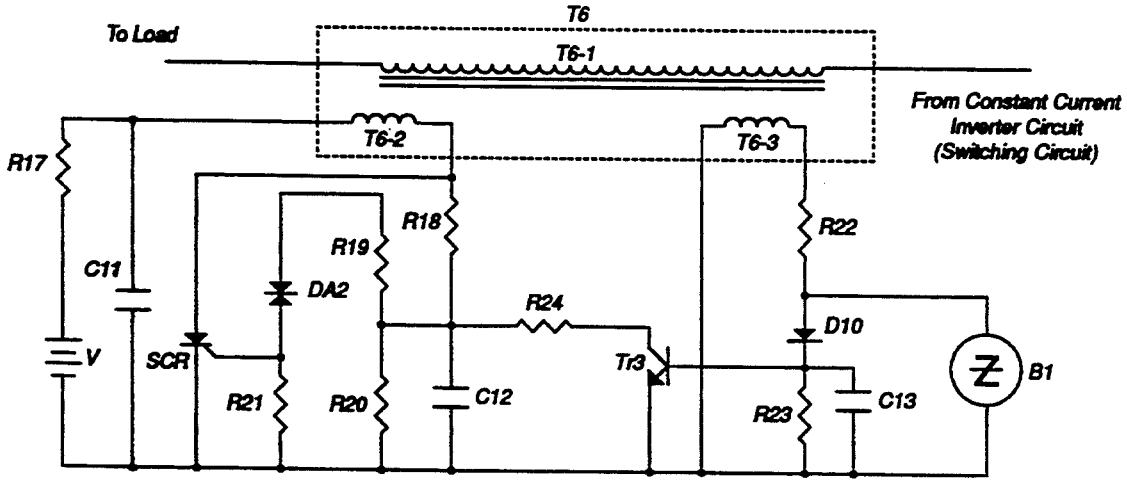
FIG. 4 is a circuit diagram of a high voltage generating circuit in FIG. 1.

Referring to FIG. 4, there is shown a circuit diagram of the high voltage generating circuit 60 in FIG. 1. The voltage V supplied to the circuit is charged on a condenser C11 through a resistor R17 according to a time constant of the condenser C11 and then applied to an anode of a SCR through a first secondary winding T6-2 of a transformer T6. Also, the voltage through the first secondary winding T6-2 of the transformer T6 is divided by resistors R18 and R21. The voltage divided by the resistors R18 and R21 is charged on a condenser C12 and then applied to a diac DA2 through a resistor R19. At this time, when the voltage on the condenser C12 is above a predetermined value, the diac DA2 is turned on, thereby causing a gate of the SCR to be driven. As a result, a high voltage pulse is generated in a primary winding T6-1 of the transformer T6 due to the charging voltage on the condenser C11. This high voltage initiates discharging between electrodes of the load or the discharge lamp.

Figure 5A:
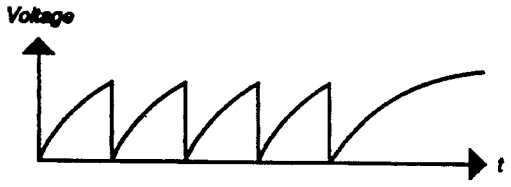
FIGS. 5A to 5C are waveform diagrams of outputs from components in the high voltage generating circuit in FIG. 4.
Figure 5B:
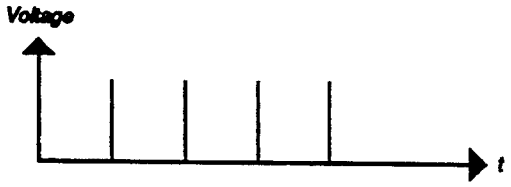
Figure 5C:
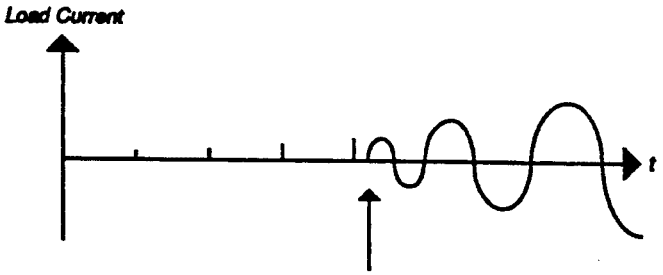
Figure 6:
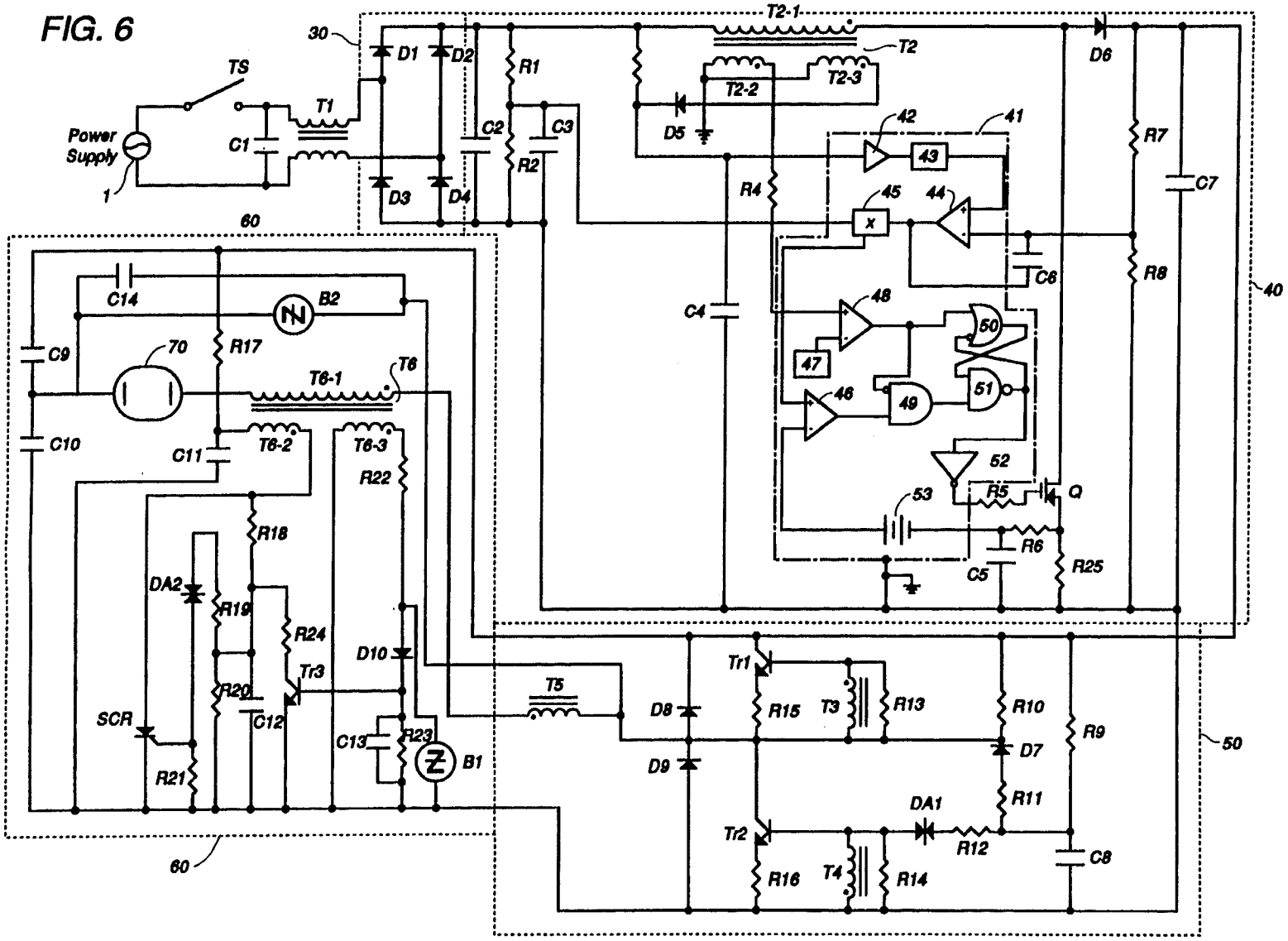
FIG. 6 is a detailed circuit diagram of the electronic ballast in FIG. 1.

This operation is repeatedly performed at a fixed period with the condenser C11 re-charged by the resistor R17. When the discharging of the discharge lamp is initiated by application of the high voltage pulse, an output current from a switching circuit is applied to the load, resulting in generation of an electromotive force in a second secondary winding T6-3 of the transformer T6. The electromotive force from the second secondary winding T6-3 of the transformer T6 is rectified through a resistor R22 and a diode D10 and then charged on a condenser C13. A varistor B1 functions as means for absorbing a high voltage pulse induced in the second secondary winding T6-3 to protect the circuit. Also, a resistor R23 functions to prevent the condenser C13 from being applied with a voltage above a predetermined value. Due to the voltage being charged on the condenser C13, a current flows to a base of a transistor Tr3, thereby causing the transistor Tr3 to be turned on or conductive. At this time, since the charging voltage on the condenser C12 becomes lower than the voltage for turning on the diac DA2 due to a parallel connection of the condenser C12 and a resistor R24, the SCR is turned off and the high voltage discharging of the discharge lamp is thus stopped. Therefore, the high voltage generating circuit 60 applies the high voltage to the load upon no current flow to the load, and can accomplish the purposes of the re-lighting of the discharge lamp as well as the initial lighting thereof. FIG. 5A is a waveform diagram of the voltage appearing across the condenser C11 when the high voltage is generated for four periods and the transistor Tr3 is then turned on. FIG. 5B is a waveform diagram of the high voltage pulse appearing across the primary winding T6-1 of the transformer T6 according to FIG. 5A, and FIG. 5C is a waveform diagram of the current to the load, Referring to FIG. 6, there is shown a detailed circuit diagram of the electronic ballast in FIG. 1. A supply voltage 1 is applied to the full-wave rectifying circuit 30 through a temperature switch TS and a noise removing filter. The temperature switch TS is opened under an abnormal high temperature condition to protect the circuits from overheat. The noise removing filter is comprised of a condenser C1 and a transformer T1. The full-wave rectifying circuit 30 is provided with a plurality of diodes D1–D4. The full-wave rectified voltage from the full-wave rectifying circuit 30 is applied to the power factor correction and constant voltage circuit 40.

In the power factor correction and constant voltage circuit 40, the full-wave rectified voltage is charged on a condenser C2, divided by resistors R1 and R2 and then applied to a control circuit 41. A condenser C3 functions to soften an abrupt variation in the divided voltage. Also, the full-wave rectified voltage is charged on the condenser C4 through a resistor R3 and then applied as a source voltage to the control circuit 41. The full-wave rectified voltage is also applied to a primary winding T2-1 of a transformer T2. A current flowing through the primary winding T2-1 is applied to the control circuit 41 through a first secondary winding T2-2 and a resistor R4. An electromotive force in a second secondary winding T2-3 of the transformer T2 is rectified by a diode D5 and then charged on the condenser C4. As a result, the control circuit 41 is driven by the current through the resistor R3 upon application of the supply voltage, but by the electromotive force in the second secondary winding T2-3 of the transformer T2 once the current flowing through the whole of the circuit is above a predetermined value. This minimizes a power loss resulting from the resistor R3. A field effect transistor (FET) Q as a switching device has a drain connected to an output terminal of the primary winding T2-1 of the transformer T2. A gate of the FET Q is driven by a control output from the control circuit 41 via a resistor R5 and a current flowing through a source of the FET Q is applied in the form of voltage to the control circuit 41 through a current detecting resistor R25. A resistor R6 and a condenser C5 constitutes a low pass filter for removing a noise component from a switching current from the FET Q and applying the resulting current to the control circuit 41. The full-wave rectified current flowing through the primary winding T2-1 of the transformer T2 and a counter electromotive force resulting from the switching of the FET Q are charged on the condenser C7 through the diode D6. The charging voltage on the condenser C7 is a main voltage for the circuits. This voltage is also divided by resistors R7 and R8 and then applied to the control circuit 41. A condenser C6 functions to compensate for a frequency of a differential amplifier 44 in the control circuit 41.

In detail, in the control circuit 41, a Schmidt trigger circuit 42 is driven to operate a constant voltage source 43, when the charging voltage on the condenser C4 is above a predetermined value. The differential amplifier 44 inputs an output voltage from the constant voltage source 43 at its non-inverting input terminal and the voltage divided by the resistors R7 and R8 at its inverting input terminal. A multiplier 45 multiplies the voltage divided by the resistors R1 and R2 by an output voltage from the differential amplifier 44 and outputs the resulting voltage via a differential amplifier 46 to a flip-flop which is comprised of gates 49–52. As a result, an output voltage from the flip-flop is applied as a drive voltage to the gate of the FET Q through the resistor R5.

A comparator 48 inputs the load current applied through the first secondary winding T2-2 of the transformer T2 and the resistor R4 and a reference voltage from a reference voltage source 47 and drives the flip-flop according to a period of the load current. The differential amplifier 46 is adapted to control the FET Q in response to the output voltage from the multiplier 45, the current applied in the form of voltage through the resistors R25 and R6 and the condenser C5 and an output voltage from a constant voltage source 53. Namely, the differential amplifier 46 outputs a signal for turning off the FET Q when the current flowing through the primary winding T2-1 of the transformer T2 is above the reference voltage. In this case, the FET Q remains at its off state until the current flowing through the primary winding T2-1 of the transformer T2 reaches zero. Also, at this time, a counter electromotive force is generated in the first secondary winding T2-2 of the transformer T2 and then applied to the comparator 48. If the applied counter electromotive force is below the reference voltage, the comparator 48 outputs a signal for turning on the FET Q. As a result, the operation returns to the initial state. This operation is repeatedly performed.

A counter electromotive force is generated every switching of the FET Q, and is higher than the supply voltage. This counter electromotive force is charged on the condenser C7 through the diode D6. Thus applied to the load is a voltage higher than a peak value of the supply voltage. The voltage applied to the load is maintained constant by the resistors R7 and R8 and the control circuit 41. Namely, the load voltage is in the form of constant voltage. In this case, controlling the current flowing through the primary winding T2-1 of the transformer T2 ensures that the DC voltage is stable regardless of a variation in the circuit supply voltage. Also, controlling directly the current being applied to the load maintains the current at the circuit voltage supply stage constant, thereby allowing the power factor at the input stage to approximate to an ideal value. Then, the constant voltage from the circuit 40 is applied to the constant current inverter circuit 50.

In the constant current inverter circuit 50, the constant voltage 40 from the circuit 40 is charged on a condenser C8 through a resistor R9. When the charging voltage on the condenser C8 is above a predetermined value, the transistor Tr2 is instantaneously turned on by a resistor R12 and a diac DA1, resulting in flow of the load current. When the load current is above a predetermined value, the saturable transformers TS, T3 and T4 are saturated, as mentioned above with reference to FIG. 3A. As a result, the actuation of the inverter circuit 50 is started. Here, resistors R13 and R14 function to limit base drive currents of the switching transistors Tr1 and Tr2 and resistors R15 and R16 function to compensate for emitter currents of the switching transistors Tr1 and Tr2. Also, diodes D8 and D9 function to protect the transistors Tr1 and Tr2 from a counter electromotive force resulting from an inductive component of the load. A square wave pulse resulting from the alternate on/off operations of the switching transistors Tr1 and Tr2 is applied to the high voltage generating circuit 60.

In the high voltage generating circuit 60, the square wave pulse from the constant current inverter circuit 50 is converted into the sinusoidal wave current by the series resonance circuit which is comprised of the primary winding T6-1 of the transformer T6, the discharge lamp 70 and the condensers C9 and C10, and then applied to the discharge lamp 70. The high voltage pulse is generated by the windings T6-1, T6-2 and T6-3 of the transformer T6 upon the initial lighting of the discharge lamp 70 and the high voltage generating circuit 60 is broken upon the normal lighting of the discharge lamp 70 or the application of the normal drive current to the discharge lamp 70, as mentioned above with reference to FIGS. 4 and 5A–5C. Here, a condenser C14 and a varistor B2 act to form a high voltage loop with the primary winding T6-1 of the transformer T6 and the discharge lamp 70, so as to protect the discharge lamp 70 against other driving circuits upon lighting. invention, the instantaneous starting and lighting of the discharge lamp can readily been performed regardless of a variation in the input voltage by using the constant current inverter as the discharge lamp drive current source and the consumption power can be reduced by the high power factor and efficiency. Therefore, the power factor at the input stage can be enhanced and the life of the discharge lamp can be increased.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An electronic ballast of the high power factor-constant power type, comprising:

power factor correction and constant voltage means for inputting a supply voltage through a temperature switch, a noise removing filter and a full-wave rectifying circuit, said power factor correction and constant voltage means storing electric energy during a conductive period of a load and, using a counter electromotive force resulting from the electric energy during a non-conductive period of the load, enhancing a power factor at an input stage and generating a constant voltage regardless of a variation in the supply voltage, said temperature switch being opened under an abnormal high temperature condition to protect circuits from overheat, said noise removing filter including a condenser and a transformer, said full-wave rectifying circuit including a plurality of diodes;

constant current inverter means connected to said power factor correction and constant voltage means to convert the constant voltage from said power factor correction and constant voltage means into a sinusoidal wave voltage, so as to supply a constant current for maintaining a normal lighting state of a discharge lamp; and high voltage generating means connected to said power factor correction and constant voltage means to supply a high voltage pulse for initial discharging between electrodes of the discharge lamp.

2. An electronic ballast of the high power factor-constant power type, as set forth in claim 1, wherein said power factor correction and constant voltage means includes:

a first condenser connected across said full-wave rectified circuit to smooth a full-wave rectified voltage from said full-wave rectified circuit;

first and second resistors connected across said first condenser to divide a charging voltage on said first condenser;

a second condenser having one side connected to a connection point of said first and second resistors and the other side connected to a ground together with said second resistor, said second condenser softening an abrupt variation in the voltage divided by said first and second resistors;

a transformer having a primary winding and first and second secondary windings, said transformer being connected to a connection point of said first condenser and said first resistor to generate said counter electromotive force;

a first diode having an anode terminal connected to said primary winding of said transformer;

a third condenser connected between a cathode terminal of said first diode and the ground to operate as a main voltage source;

third and fourth resistors connected to a connection point of said first diode and said third condenser to divide a charging voltage on said third condenser;

a fifth resistor connected to a connection point of said first resistor and said primary winding of said transformer;

a second diode having an anode terminal connected to one side of said second secondary winding of said transformer, the other side of which is connected to the ground;

a fourth condenser having one side connected between said fifth resistor and a cathode terminal of said second diode and the other side connected to the ground;

a sixth resistor connected to one side of said first secondary winding of said transformer, the other side of which is connected to the ground;

a FET having a drain terminal connected to a connection point of said primary winding of said transformer and said first diode, a source terminal connected to one side of a seventh resistor, the other side of which is connected to the ground, and a gate terminal connected to an eighth resistor;

a ninth resistor and a fifth condenser connected to a connection point of said source terminal of said FET and said seventh resistor, said ninth resistor and said fifth condenser constituting a low pass filter, said fifth condenser having one side connected to said ninth resistor and the other side connected to the ground; and a control circuit connected to a connection point of said second diode and said fourth condenser, the connection point of said first and second resistors, a connection point of said third and fourth resistors and said sixth resistor to output through said eighth resistor a control signal for switching said FET.

3. An electronic ballast of the high power factor-constant power type, as set forth in claim 1, wherein said constant current inverter means includes:

a first resistor and a first condenser connected in series to each other and in parallel across a condenser at an output stage of said power factor correction and constant voltage means;

a second resistor, a first diode and a third resistor connected in series to one another and in parallel across said first resistor;

a first transistor having a base terminal connected to a cathode terminal of said first diode through a first transformer and a fourth resistor, an emitter terminal connected to the cathode terminal of said first diode through an emitter current compensating fifth resistor and a collector terminal connected to said second resistor;

a second transistor having a base terminal connected to a ground through a second transformer and a sixth resistor and to a connection point of said first resistor and said first condenser through a diac and a seventh resistor, a collector terminal connected to the cathode terminal of said first diode and an emitter terminal connected to the ground through an emitter current compensating eighth resistor;

a second diode having a cathode terminal connected to the collector terminal of said first transistor and an anode terminal connected to said emitter current compensating fifth resistor;

a third diode having a cathode terminal connected to the collector terminal of said second transistor and an anode terminal connected to said emitter current compensating eighth resistor; and a third transformer connected to a connection point of the anode terminal of said second diode and the cathode terminal of said third diode.

4. An electronic ballast of the high power factor-constant power type, as set forth in claim 1, wherein said high voltage generating means includes:

a transformer having a primary winding and first and second secondary windings, said transformer being connected between a transformer at an output stage of said constant current inverter means and one side of the discharge lamp;

a first resistor connected to a cathode terminal of a first diode at the output stage of said constant current inverter means;

a first condenser connected between a connection point of the first secondary winding of said transformer and said first resistor and a ground;

a second resistor connected to the first secondary winding of said transformer;

a third resistor connected between said second resistor and the ground;

a second condenser having one side connected to a connection point of said second and third resistors and the other side connected to the ground;

a fourth resistor, a diac and a fifth resistor connected in series between the connection point of said second and third resistors and the ground;

a SCR having a cathode terminal connected to the ground, an anode terminal connected to the first secondary winding of said transformer and a gate terminal connected to a connection point of said diac and said fifth resistor;

a sixth resistor, a diode and a seventh resistor connected in series between one side of the second secondary winding of said transformer, the other side of which is connected to the ground, and the ground;

a circuit protecting first varistor connected between a connection point of said sixth resistor and an anode terminal of said diode and the ground;

a third condenser connected between a connection point of a cathode terminal of said diode and said seventh resistor and the ground;

a transistor having a base terminal connected to the connection point of the cathode terminal of said diode and said seventh resistor, a collector terminal connected to the connection point of said second and third resistors through an eighth resistor and an emitter terminal connected to the ground;

fourth and fifth condensers connected in series between the cathode terminal of the first diode at the output stage of said constant current inverter means and the ground and connected commonly to the other side of the discharge lamp; and a sixth condenser and a second varistor connected in parallel between a common connection point of said fourth and fifth condensers and the other side of the discharge lamp and a connection point of said first diode and a second diode at the output stage of said constant current inverter means.

* * * * *

UNITED STATES PATENT AND TRADEMARK OFFICE

CERTIFICATE OF CORRECTION

PATENT NO. : 5,371,443

DATED : December 6, 1994

INVENTOR(S) : Seo H. Sun; Seong K. Young; Han M. Su

It is certified that error appears in the above-indentified patent and that said Letters Patent is hereby corrected as shown below:

On the title page, in the identification of Assignee, delete "Hyun In Information Corporation" and insert -- Han Wha Corporation and Hyun In Information Corporation--.

Signed and Sealed this

Second Day of July, 1996

*Attest:*

*Attesting Officer*

BRUCE LEHMAN

*Commissioner of Patents and Trademarks*